United States Patent [19]

Baumberg

[11] Patent Number: 4,539,471

[45] Date of Patent: Sep. 3, 1985

[54] HYDRAULIC COUNTING CELL

[76] Inventor: Iosif Baumberg, 54 Bay 29 St., Brooklyn, N.Y. 11214

[21] Appl. No.: 605,131

[22] Filed: Apr. 30, 1984

[51] Int. Cl.[3] ..... G06D 1/08

[52] U.S. Cl. ..... 235/201 PF

[58] Field of Search ..... 235/200 R, 201 R, 201 FS, 235/201 PF

[56] References Cited

U.S. PATENT DOCUMENTS 2,082,211 6/1937 Moore ..... 235/200 R

OTHER PUBLICATIONS

IBM Technical Disclosure Bulletin, "Fluidic Logic Block", F. J. Campagne et al., vol. 14, No. 10, Mar. 1972.

*Primary Examiner*—Benjamin R. Fuller

*Attorney, Agent, or Firm*—Ilya Zborovsky

[57] ABSTRACT

A hydraulic recalculating cell has a substantially vertical inlet portion, an inclined portion connected by its lower end with a lower end of the inlet portion, a further substantially vertical portion connected by its upper end with an upper end of the inclined portion above the first connection, and a divider including two downwardly open pipes connected with the further pipe.

6 Claims, 2 Drawing Figures

HYDRAULIC COUNTING CELL

BACKGROUND OF THE INVENTION

The present invention deals with a hydraulic counting (recalculating) cell for counting and memorizing with a digital indication, of drops of liquid received at an inlet of the cell and can be used in flowmeters and dosers of liquid utilized in industry and agriculture, for example in the systems of dripping irrigation, intravenous plasma infusion, digital devices of pneumohydroautomatic machines etc.

In modern calculating technique and automated control system binary system of calculations is used with the utilization of two digit, namely "0" and "1". It operates with the aid of bistable elements, such as triggers with complementing inputs and cells for recalculating to two. The known bistable elements has the disadvantages that they need energy supply sources, devices for withdrawal of counting results or visualizing of the counting results, inlet converters. For example for counting of drops it is necessary to transform the action of each drop into an electrical or mechanical impulse, depending upon the construction of the used cell. An important disadvantage of all recalculating cells is a loss of information in response to even a very short disconnection of the cells for the energy supply source. Liquid dividers are also known and has the disadvantage in that they are not provided with a counting (complementing) input and digital indication.

SUMMARY OF THE INVENTION

Accordingly, it is an object of the present invention to provide a hydraulic counting (recalculating) cell which avoids the disadvantages of the prior art.

More particularly, this an object of the present invention is attained in that a hydraulic counting cell has an inlet portion with a substantially vertical axis, an inclined portion with a lower end connected with a lower end of the inlet portion, a further portion having a substantially vertical axis and connected by its upper end with an upper end of the inclined portion with the inclined portion forming a short portion and the further leg forming a long leg of a siphon, and two pipes connected with a lower end of the further portion and forming an outlet of the device, wherein the second connection is located above the first connection.

The novel features of the present invention are set forth in the claims. The invention itself is disclosed in the following description accompanied by the following drawing.

DESCRIPTION OF A PREFERRED EMBODIMENT

Figure 1:
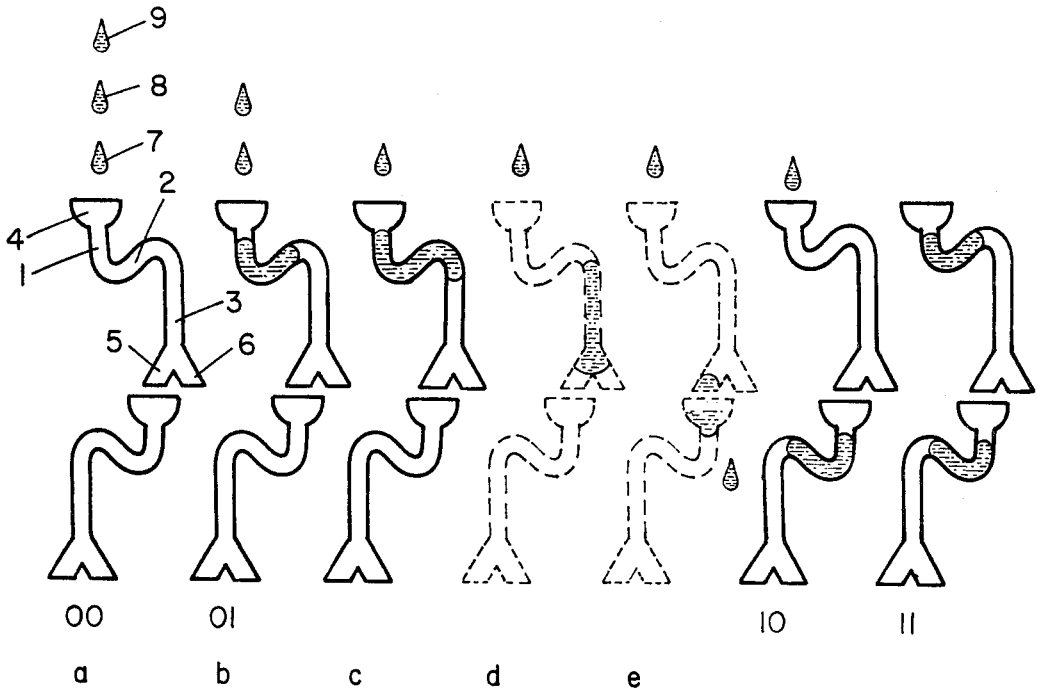
FIG. 1 shows a hydraulic recalculating device including two consequtively connected hydraulic recalculating cells with successive phases of operation.

A hydraulic recalculating cell is formed as a pipe including an inlet portion 1 with a substantially vertical axis, an inclined portion 2 forming a short leg of a siphon, and a further portion with a substantially vertical axis forming a long leg of the siphon. The portions 1 and 2 are connected with one another by a lower bend, whereas the portions 2 and 3 are connected with one another by an upper bend located higher that the lower bend. The upper end of the inlet portion 1 terminates with an upwardly facing funnel 4 which forms an inlet of the device. The lower end of the further portion 3 is connected with a flow divider which includes two pipes 5 and 6 located symmetrically relative to the portion 3 and having downwardly open ends which forms an outlet of the device. The pipes 5 and 6 together with the portion 3 form a tee with one inlet and two outlet branches.

The device including the hydraulic recalculating cells in accordance with the present invention operates in the following manner.

For normal operation of the device the drops to be counted must have a volume $V_o$ which is lower than the sum of the inner volumes of the inlet portion 1, the inclined portion or the short leg of the siphone 2, and the bend therebetween confined between the horizontal planes extending between the lowest point of the lower bend and the highest point of the upper bend $V_1$. The double volume of each drop or the volume of two drops must be greater than the total volume of the pipe confined between the horizontal planes extending through the highest point of the upper bend and the lowest point of the lower bend $V_2$.

$$V_o < V_1 \text{ and } 2V_o > V_2$$

The drawing shows three liquid drops which follow one another and identified with reference numerals 7, 8 and 9. The fall in the direction toward the inlet funnel 4.

Before the receipt of the drop 7 into the inlet of the recalculating cell of the first order (the upper cell) the cells of both orders are in a zero position "00" since none of the short legs of the siphon contains the liquid, as shown in position a. Since the volume of the drop satisfies the condition $V_o < V_1$, after the first drop 7 enters the device it will be accommodated in the inlet portion 1, the short leg 2 of the siphon, and the lower bend connecting them with one another, as shown in the position b. The location of the drops in the above mentioned parts of the cell means the number 01. After the second drop enters the device, the total volume of the liquid in the upper recalculating cell or the cell of the first order will become equal to $2V_o$, and the height of the liquid colum in the longer leg 3 of the siphon will become greater that the height of the liquid colum in the short leg 2 of the siphon. The passage of the drops through the respective portions of the upper and lower cells and the respective locations of the drops which mean the respective numbers is shown in FIG. 1.

Positions c,d,e show a transitional process of transition of the drops between the position corresponding to the digit 01 to the position corresponding to the digit 10.

Figure 2:
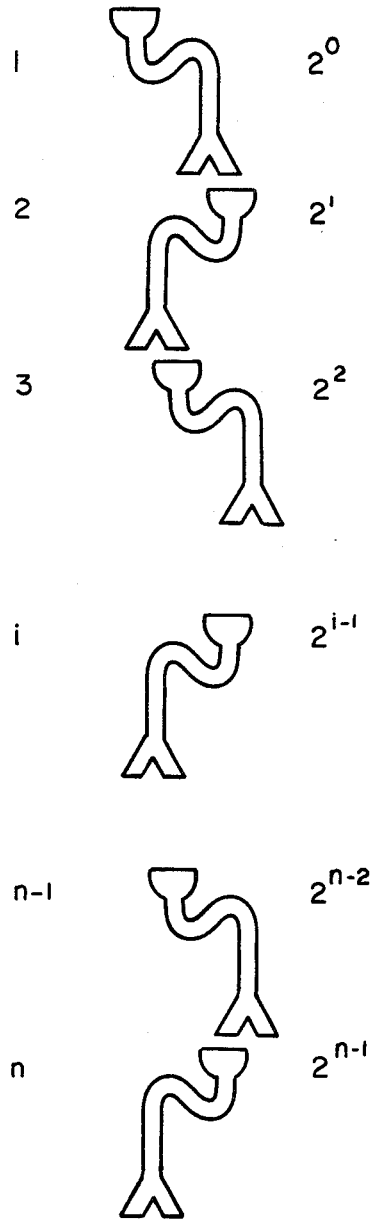
FIG. 2 shows the device with a plurality of the consequitively connected hydraulic recalculating cells, in accordance with the present invention.

FIG. 2 of the drawing shows a plurality of the hydraulic recalculating cells arranged one under the other. Their operation are believed to be obvious from the drawing.

For obtaining the visual results of the counting, for example, the cells can be made transparent and located between a source of light and a screen. Depending upon the location of the drops in the respective portions of the cells and the respective cells of the device, the respective numbers will appear on the screen.

The invention is not limited to the details shown since various modifications and structural changes are possible without departing in any way from the spirit of the present invention.

What is desired to be protected by Letters Patent is set forth in particular in the appended claims.

I claim:

1. A hydraulic counting cell, comprising an inlet portion arranged for receiving a plurality of drops of a liquid sucessively after one another and having a substantially vertical portion and a lower end;

an inclined portion having upper and lower ends and forming a short leg of a siphon, said lower end of said inlet portion being connected with said lower end of said inclined portion at a predetermined height so that the drops of liquid pass into said inclined portion from said inlet portion;

a further portion having a substantially vertical axis and upper end lower ends forming a long leg of the siphon, said upper end of said further portion being connected with said upper end of said inclined portion at a height exceeding the first-mentioned height so that the drops of liquid pass into said further portion from said inclined portion; and a flow dividing portion including two pipes with upper ends connected with said lower end of said further portion so that the drops of liquid pass into said flow dividing portion from said further portion, said two pipes also (and) having open lower ends so as to discharge the drops of liquid and to form an outlet of the cell, whereby during passage of the drops of liquid they are successively counted in accordance with their position in said portions.

2. A hydraulic counting cell as defined in claim 1; and further comprising a first curved section which connects said lower end of said inlet portion with said lower end of said inclined portion at said first-mentioned height.

3. A hydraulic counting cell as defined in claim 1; and further comprising a second curved section which connects said upper end of said inclined portion with said upper end of said further portion.

4. A hydraulic counting cell as defined in claim 1, wherein said pipes are arranged symmetrically relative to said further portion.

5. A hydraulic counting cell as defined in claim 1; and further comprising a funnel-shaped portion which is open upwardly and connected with an upper end of said inlet portion.

6. A hydraulic recalculating device, comprising a plurality of hydraulic counting cells each having an inlet portion arranged for receiving a plurality of drops of a liquid successively after one another and having a substantially vertical portion and a lower end, an inclined portion having upper and lower ends and forming a short leg of a siphon wherein said lower end of said inlet portion is connected with said lower end of said inclined portion at a predetermined height so that the drops of liquid pass into said inclined portion from said inlet portion, a further portion having a substantially vertical axis and upper and lower ends forming a long leg of the siphon wherein said upper end of said further portion is connected with said upper end of said inclined portion at a height exceeding the first-mentioned height so that the drops of liquid pass into said further portion from said inclined portion, and a flow dividing portion including two pipes with upper ends connected with said lower ends of said further portion so that the drops of liquid pass into said flow dividing portion from said further portion, and said two pipes also having open lower ends so as to discharge the drops of liquid and to form an outlet of the cell, whereby during passage of the drops of liquid they are successively counted in accordance with their position in said portions, said hydraulic counting cells being arranged one above the other so as to allow a liquid flow from each upper cell to a neighboring lower cell.

* * * * *